US006615728B2

(12) United States Patent
Kurata et al.

(10) Patent No.: US 6,615,728 B2
(45) **Date of Patent: *Sep. 9, 2003**

(54) PRINTING PRESS AND PRINTING PRESS CONTROL METHOD

(75) Inventors: Yoshiaki Kurata, Ibaraki (JP); Hideki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/860,066

(22) Filed: May 17, 2001

(65) Prior Publication Data

US 2001/0042484 A1 Nov. 22, 2001

(30) Foreign Application Priority Data

May 17, 2000 (JP) ..... 2000/145549

(51) Int. Cl.[7] ..... B41F 1/54
(52) U.S. Cl. ..... 101/484; 101/365; 101/478
(58) Field of Search ..... 101/365, 483, 101/478

(56) References Cited

U.S. PATENT DOCUMENTS

| | | | | |
|---|---|---|---|---|
| 5,237,923 A | * | 8/1993 | Williams et al. | 101/467 |
| 5,379,698 A | | 1/1995 | Nowak et al. | |
| 5,884,562 A | | 3/1999 | Sugiyama et al. | |
| 5,921,184 A | | 7/1999 | Sugiyama et al. | |
| 5,988,067 A | * | 11/1999 | Ishida et al. | 101/183 |
| 6,101,944 A | * | 8/2000 | Schmid et al. | 101/463.1 |

FOREIGN PATENT DOCUMENTS

| | | | | |
|---|---|---|---|---|
| DE | 3911932 A | | 10/1990 | |
| DE | 19506425 A1 | | 8/1996 | |
| EP | 0771646 | | 5/1997 | |
| EP | 0867279 A1 | * | 9/1998 | B41F/7/02 |
| JP | 63-127923 | | 5/1988 | |
| JP | 63-134244 | | 6/1988 | |
| JP | 2-258993 | | 10/1990 | |
| JP | 2-286245 | | 11/1990 | |
| JP | 3-114748 | | 5/1991 | |
| JP | 5-200995 | | 8/1993 | |
| JP | 9-039215 | | 2/1997 | |
| JP | 10-016193 | | 1/1998 | |
| JP | 10-193578 | | 7/1998 | |
| JP | 10-286944 | | 10/1998 | |

* cited by examiner

*Primary Examiner*—Charles H. Nolan, Jr.
(74) *Attorney, Agent, or Firm*—Blakely, Sokoloff, Taylor & Zafman

(57) ABSTRACT

A printing press includes an ink roller group, image exposing section, pre-inking controller, and CPU. The ink roller group supplies ink stored in an ink fountain to a printing plate mounted on a plate cylinder. The image exposing section exposes an image on a printing plate before plate making which is mounted on the plate cylinder. The pre-inking controller forms an ink film thickness distribution corresponding to the image to be exposed on the printing plate on the ink roller group. The CPU performs image exposing and ink film thickness distribution formation concurrently at least partly by controlling the image exposing section and the pre-inking controller. A control method for a printing press is also disclosed.

12 Claims, 12 Drawing Sheets

PRINTING PRESS AND PRINTING PRESS CONTROL METHOD

BACKGROUND OF THE INVENTION

The present invention relates to a printing press and, more particularly, to a printing press having a on-machine plate making function of exposing an image on a printing plate mounted on a plate cylinder and an ink film thickness control function.

Recently, to improve the efficiency of plate making and register accuracy, a printing press has been designed to directly perform plate making by using a plate making apparatus incorporated in the printing press itself. That is, a graphic pattern (image) is exposed on a printing plate (raw plate) mounted on a plate cylinder by irradiating it with a laser beam from the head of a plate making apparatus incorporated in a printing unit instead of using a plate making apparatus provided independently of the printing press. This operation is called on-machine plate making.

More specifically, the printing press is accelerated to a designated rotational speed. When the rotational speed is stabilized, laser radiation (exposure) from the head to a raw plate is started. Thereafter, the head is moved in the axial direction of the plate cylinder during exposure to expose an image on the entire plate. The exposure time is determined by the size of the plate and the designated rotational speed during exposure. As a technique of exposing an image on a raw plate by laser radiation, the technique disclosed in U.S. Pat. No. 5,379,698 (reference 1) is incorporated in this specification.

FIG. 8 shows how plate making apparatuses are incorporated in a four-color web offset printing press. Referring to FIG. 8, reference numerals 1-1 to 1-4 denote printing units for the respective ink colors. Plate making apparatuses 2-1 to 2-4 are respectively incorporated in the printing units 1-1 to 1-4. The plate making apparatuses 2-1 to 2-4 are normally located at the positions indicated by the chain double-dashed lines in FIG. 8 and brought near to plate cylinders 3 in the printing units 1-1 to 1-4 when exposure is performed. Reference numeral 4 denotes a blanket cylinder which is in contact opposite to the plate cylinder and on which a blanket is mounted. Impression cylinders (not shown) are respectively placed below the blanket cylinders 4.

FIG. 9 shows the main part of a plate making apparatus 2. The plate making apparatus 2 includes an exposure apparatus 2*b* having a head 2*a*. The exposure apparatus 2*b* is fixed on a table 2*c*. The table 2*c* moves in the axial direction (the direction indicated by arrows A and B in FIG. 9) of the plate cylinder 3 while being guided by rails 2*f*1 and 2*f*2 on a stage 2*f*. A raw plate 5 before plate making is mounted on the plate cylinder 3.

[Ink Film Thickness Control]

To adjust the amount of ink to be supplied and decrease the number of times of test printing until a desired tone is obtained, an ink film thickness control method like that disclosed in U.S. Pat. Nos. 5,884,562 (reference 2) and 5,921,184 (reference 3) has been proposed. These references disclose ink film thickness control methods called "pre-inking 1" and "pre-inking 2". According to the ink film thickness control methods disclosed in these references, when a printing plate is set in the plate cylinder for the first time, an ink film thickness distribution is formed in the inking device by "pre-inking 1". When an old printing plate is to be changed to a new printing plate, an ink film thickness distribution is formed in the inking device by "pre-inking 2".

The technique disclosed in references 1 and 2 is incorporated in this specification.

FIG. 10 shows the main part of the inking device (inker) in a printing unit 1. Reference numeral 6 denotes an ink fountain; 7, an ink stored in the ink fountain 6; 8, an ink fountain roller; 9, a plurality of ink fountains aligned in the axial direction of the ink fountain roller 8; 10, an ink ductor roller; 11, an ink roller group; and 12, a printing plate on which an image has already been exposed.

In the inking device having this arrangement, the ink 7 is supplied from the ink fountain 6 onto the surface of the ink fountain roller 8 through a portion between the ink fountain key 9 and the ink fountain roller 8. The ink supplied to the ink fountain roller 8 is supplied to the printing plate 12 via the ink roller group 11 upon ink feed operation of the ink ductor roller 10. The ink supplied to the printing plate 12 is printed on printing paper.

When the old printing plate is changed to the new printing plate 12, the opening amount of the ink fountain key 9, the rotation amount of the ink fountain roller 8, and the like are preset to values corresponding to the image on the printing plate 12. More specifically, by setting the opening amount of the ink fountain key 9, the rotation amount of the ink fountain roller 8, and the like to the values corresponding to the image on the printing plate 12, the ink 7 in the ink fountain 6 is supplied to the printing plate 12 via the ink roller group 11. In this case, test printing is performed before final printing to obtain a satisfactory tone while adjusting the amount of ink to be supplied. With this operation, a desired ink film thickness distribution (ink film thickness gradient) is formed on the ink roller group 11.

When the old printing plate is changed to the new printing plate 12, the ink film thickness distribution is left on the ink roller group 11. For the new printing plate 12, this ink film thickness distribution for the old printing plate must be gradually changed to an ink film thickness distribution suited to the new printing plate 12. For this reason, to obtain a satisfactory tone, adjustment of the amount of ink to be supplied and test printing are required to excessive degrees, resulting in problems, e.g., an increase in printing preparation time, an increase in work load, a waste of printing materials, a decrease in production efficiency, and an increase in cost.

According to references 2 and 3 described above, when the old printing plate is to be changed to the printing plate 12, ink removing operation is performed first. More specifically, ink removing is selected on a display (not shown) after a printing unit is selected. In ink removing operation, the ink feed operation of the ink ductor roller 10 is set in the OFF state, and the printing press is driven while the old printing plate is mounted to print out a predetermined number of sheets. With this operation, as shown in FIG. 11A, a minimum ink film thickness distribution Ma required during printing is left on the ink roller group 11, which decreases in thickness from upstream to downstream. That is, the basic ink film thickness distribution Ma corresponding to a portion of the printing plate 12 which has no image is left.

Pre-inking 2 is then selected on the display to perform operation of pre-inking 2. In pre-inking 2, after the opening amount of the ink fountain key 9, the rotation amount of the ink fountain roller 8, and the like are preset to values corresponding to the image on the printing plate 12, the printing press is driven, and the ink feed operation of the ink ductor roller 10 is performed a predetermined number of times. With this operation, as shown in FIG. 11B, an ink film thickness distribution (to be referred to as image ink film thickness distribution hereinafter) Mb corresponding to the image on the printing plate 12 is superimposed on the basic ink film thickness distribution Ma left on the ink roller group 11.

After the image ink film thickness distribution Mb is superimposed on the basic ink film thickness distribution Ma, test printing corresponding to a predetermined number of sheets is performed while the printing plate is changed to the new printing plate 12, thereby performing density checks on printing products produced by test printing. In the density checks, if a satisfactory tone is obtained, ink film thickness control by "pre-inking 2" is terminated, and final printing is started.

If the ink roller group 11 holds no ink, e.g., the printing plate 12 is mounted on the surface of the plate cylinder 3 for the first time, a printing unit is selected on the display first, and then pre-inking 1 is selected. In pre-inking 1, the total opening amount of the ink fountain keys 9 is initialized to a reference opening amount (e.g., 50%), and the rotation amount of the ink fountain roller 8 is initialized to a reference rotation amount (e.g., 50%). In this state, the printing press is driven, and the ink feed operation of the ink ductor roller 10 is performed a predetermined number of times to form the basic ink film thickness distribution Ma on the ink roller group 11. After the basic ink film thickness distribution Ma is formed, the opening amount of the ink fountain key 9 and the rotation amount of the ink fountain roller 8 are preset to values corresponding to the image on the new printing plate 12. The ink feed operation of the ink ductor roller 10 is then performed a predetermined number of times to superimpose the image ink film thickness distribution Mb corresponding to the printing plate 12 on the basic ink film thickness distribution Ma formed on the ink roller group 11.

In this state, test printing corresponding to a predetermined number of sheets is performed, and density checks are made on printing products produced by test printing. In these density checks, if a satisfactory tone is obtained, ink film thickness control by "pre-inking 1" is terminated, and final testing is started.

[On-machine Plate Making+Ink Film Thickness Control]

A series of operations ranging from plate making to final printing, including the above on-machine plate making and ink film thickness control, are serially performed. FIG. 12A shows conventional steps in on-machine plate making including a preparatory process (ink removing, cleaning of the impression cylinder and blanket, paper size/paper thickness preset operation, plate change, and the like) and forming an ink film thickness distribution by pre-inking 2. FIG. 12B shows conventional steps in on-machine plate making without any preparatory process and forming an ink film thickness distribution by pre-inking 2.

Referring to FIG. 12A, first of all, ink removing is performed while an old printing plate is mounted on the plate cylinder 3 (step S21) to leave the basic ink film thickness distribution Ma on the ink roller group 11. After ink removing, the impression cylinder and blanket are cleaned (step S22). Concurrently with this cleaning operation, a paper size/paper thickness is preset (step S23). An automatic plate change unit (not shown) is driven to change the old printing plate mounted on the plate cylinder 3 with a raw plate (step S24).

The plate making apparatus 2 is then driven to perform exposure, thereby exposing an image on the raw plate 5 (step S25). Pre-inking 2 is performed (step S26) to superimpose the image ink film thickness distribution Mb corresponding to the image exposed on the raw plate 5 on the basic ink film thickness distribution Ma left on the ink roller group 11. After the image ink film thickness distribution Mb is superimposed, test printing is performed (step S27). If a satisfactory tone is obtained, the flow advances to final printing (step S28).

Referring to FIG. 12B, since the above preparatory processes, i.e., the operations in steps S21 to S24 in FIG. 12A, have been completed, the subsequent process is performed from the exposure in step S25. After an image is exposed on the raw plate 5 by the exposure in step S25, pre-inking 2 is performed (step S26). Test printing is then performed (step S27), and the flow advances to final printing (step S28). The exposure time in step S25 is determined by the size of a plate and a designated rotational speed in exposure. According to a conventional, standard plate making method, the exposure time is about 3 min and 40 sec. According to a conventional, standard ink film thickness control method, it takes about 1 min and 30 sec to form an ink film thickness distribution by pre-inking 2 in step S26.

FIGS. 13A and 13B show conventional steps in serially performing on-machine plate making and ink film thickness distribution formation by pre-inking 1. FIG. 13A shows conventional steps in on-machine plate making and ink film thickness distribution formation by pre-inking 2 with a preparatory process. FIG. 13B shows conventional steps in on-machine plate making and ink film thickness distribution formation by pre-inking 2 without any preparatory process.

Referring to FIG. 13A, the flow starts with a preparatory process including cleaning of the impression cylinder, blanket, and inker, paper size/paper thickness presetting, and plate change. That is, the impression cylinder, blanket, and inker are cleaned (step S11). Concurrently with this cleaning operation, paper size/paper thickness presetting is performed (step S12). The old printing plate mounted on the plate cylinder 3 is changed to the raw plate 5 by using the automatic plate change unit (step S13). The plate making apparatus 2 is then driven to perform exposure so as to expose an image on the raw plate 5 (step S14). Pre-inking 1 is performed (step S15) to form the ink film thickness distributions Ma and Mb. After the formation of the ink film thickness distributions Ma and Mb, test printing is performed (step S16). If a satisfactory tone is obtained, the flow advances to final printing (step S17).

Referring to FIG. 13B, since the operations in steps S11 to S13 in FIG. 13A have already been completed, the flow starts with exposure in step S14. After an image is formed on the raw plate 5 by exposure in step S14, pre-inking 1 is performed (step S15). After test printing is performed (step S16), the flow advances to final printing (step S17). The exposure time in step S14 is determined by the size of a plate and the designated rotational speed in exposure. According to a conventional, standard plate making method, the exposure time is about 3 min and 40 sec. It takes about 2 min and 30 sec to form an ink film thickness distribution by pre-inking 1 in step S15.

In the processes shown in FIGS. 12A and 12B, an ink film thickness distribution is formed (step S26) between exposure (step S25) and test printing (step S27). In the processes shown FIGS. 13A and 13B, an ink film thickness distribution is formed (step S15) between exposure (step S14) and test printing (step S16).

In this case, the time taken for ink film thickness distribution formation is added to the exposure time, resulting in the prolongation of the time from plate making to final printing. In recent printing, there is a tendency to produce many types of printing plates in small lots. If, therefore, exposure in on-machine plate making is performed, it takes much time to start final printing, resulting in a significant loss in terms of operation efficiency.

SUMMARY OF THE INVENTION

It is an object of the present invention to provide a printing press which shortens the time taken until final printing in continuous execution of on-machine plate making and ink film thickness distribution formation.

In order to achieve the above object, according to the present invention, there is provided a printing press comprising an ink roller group for supplying ink stored in an ink fountain to a printing plate mounted on a plate cylinder, image exposing means for exposing an image on a printing plate before plate making which is mounted on the plate cylinder, ink film thickness distribution formation means for forming an ink film thickness distribution corresponding to the image to be exposed on the printing plate on the ink roller group, and control means for performing image exposing and ink film thickness distribution formation concurrently at least partly by controlling the image exposing means and the ink film thickness distribution formation means.

DESCRIPTION OF THE PREFERRED EMBODIMENT

The present invention will be described in detail below with reference to the accompanying drawings.

[Concurrent Execution of On-machine Plate Making and Pre-inking 2]

Figure 1A:
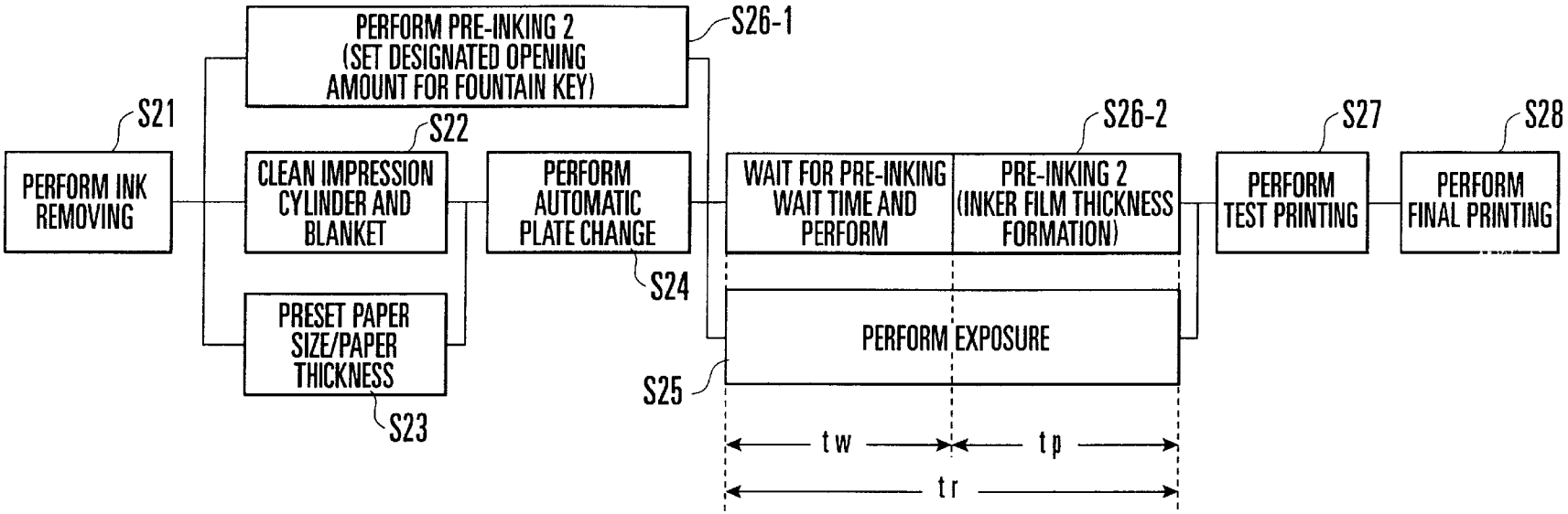
FIGS. 1A and 1B are views showing continuous processing for on-machine plate making and ink film thickness distribution formation by pre-inking 2 with and without a preparatory process.
Figure 1B:
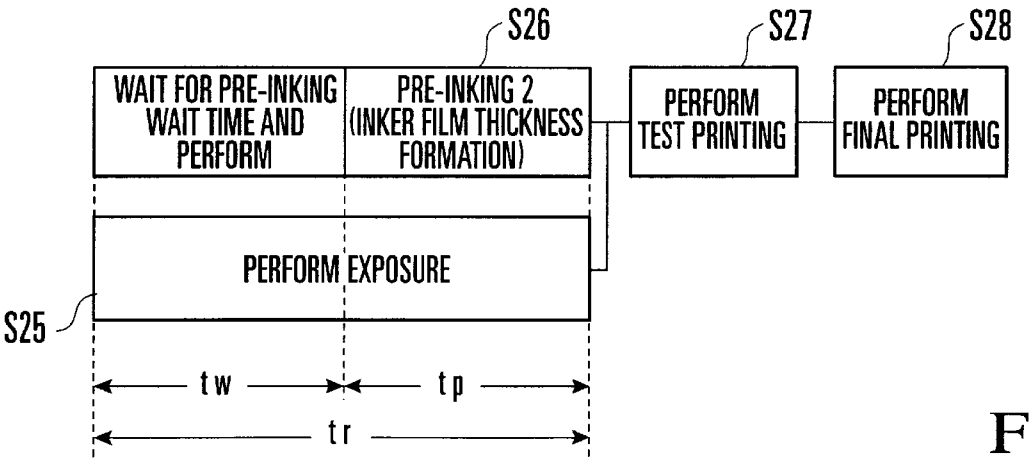
Figure 8:
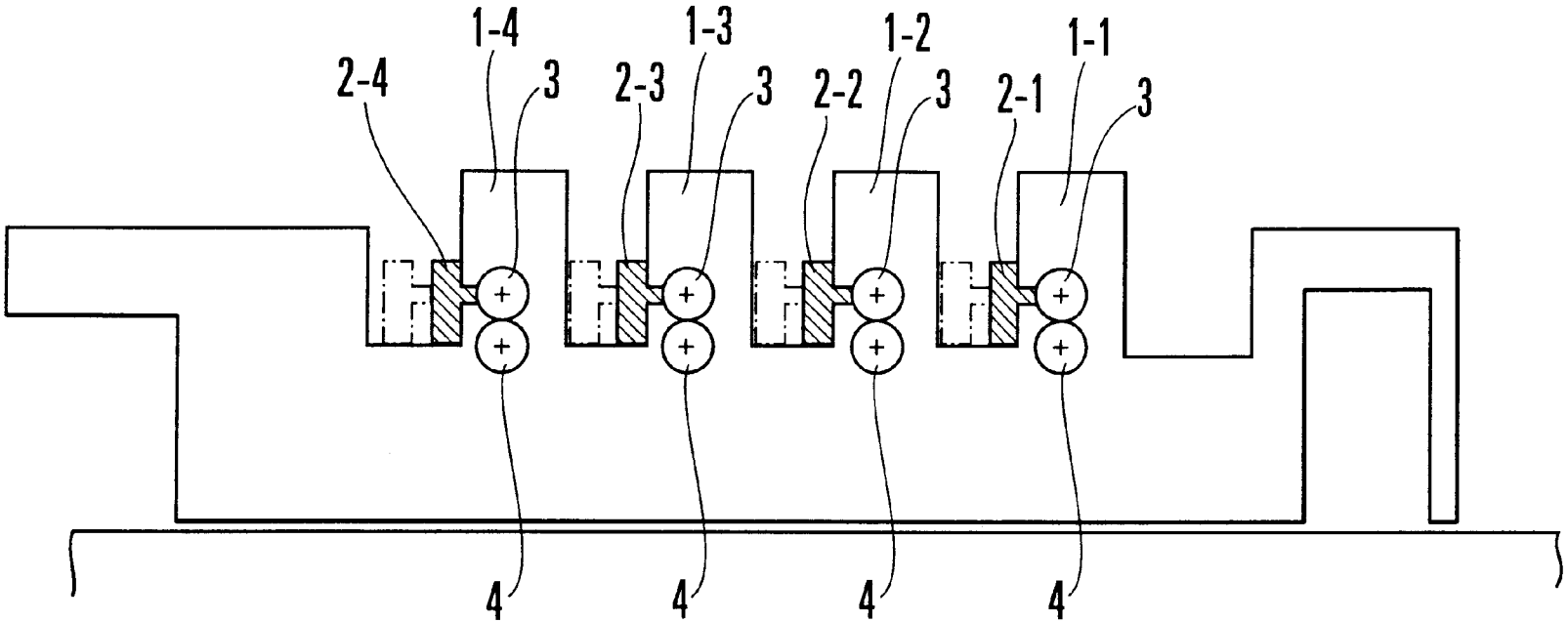
FIG. 8 is a side view of a four-color web offset printing press incorporating plate making apparatuses.
Figure 9:
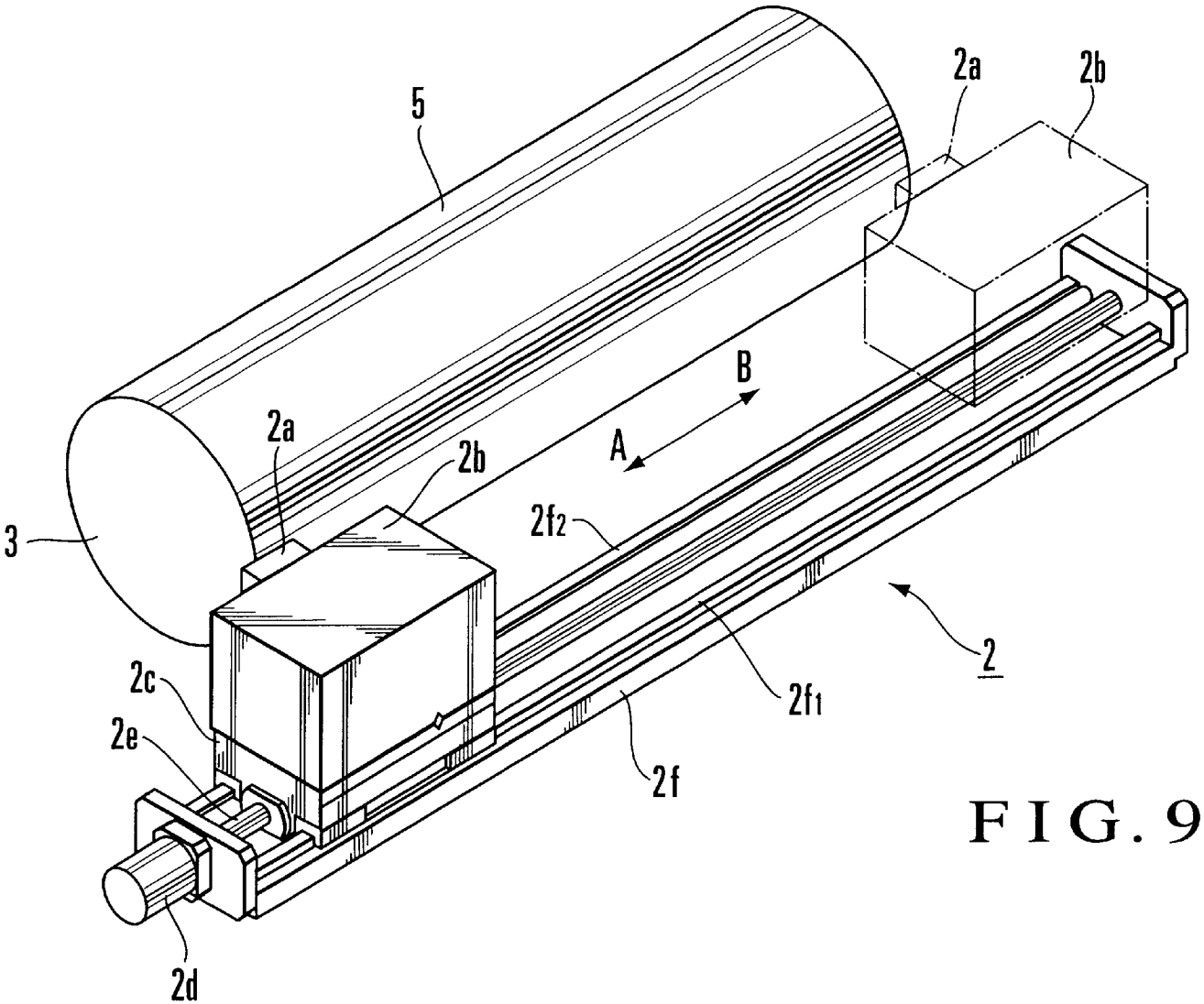
FIG. 9 is a perspective view showing the main part of the plate making apparatus.
Figure 10:
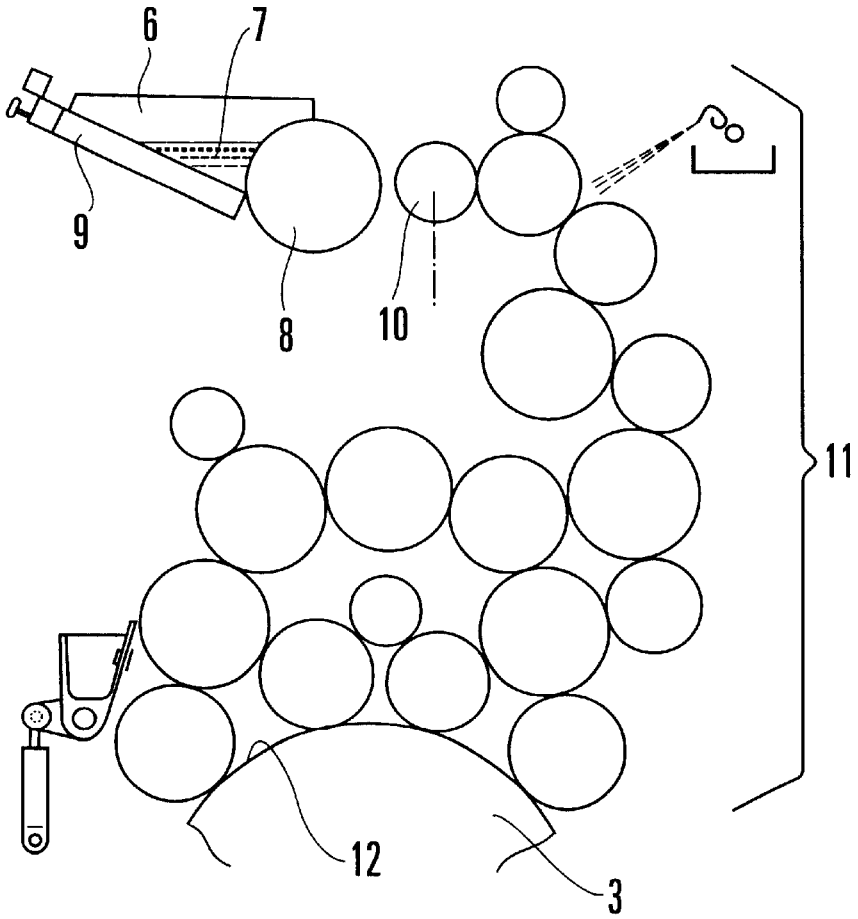
FIG. 10 is a schematic view of an inking device (inker) in a printing unit.
Figure 11A:
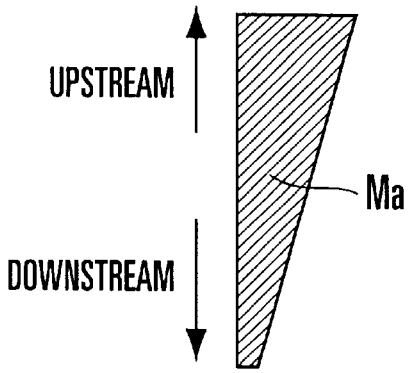
FIGS. 11A and 11B are views showing ink film thickness distributions Ma an Mb formed on the ink roller group of the inking device.
Figure 11B:
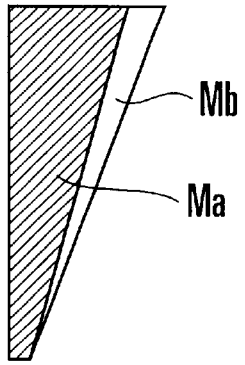
Figure 12A:
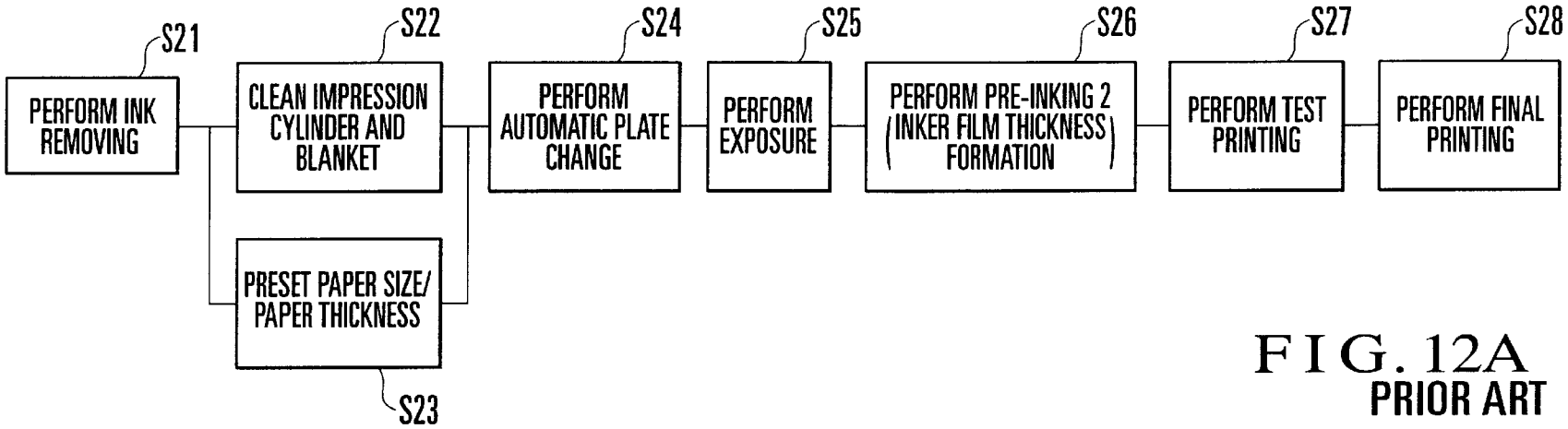
FIG. 12A PRIOR ART
FIG. 12A and 12B are views showing the conventional steps in serial processing for on-machine plate making and ink film thickness distribution formation by pre-inking 2 with and without a preparatory process.
Figure 12B:
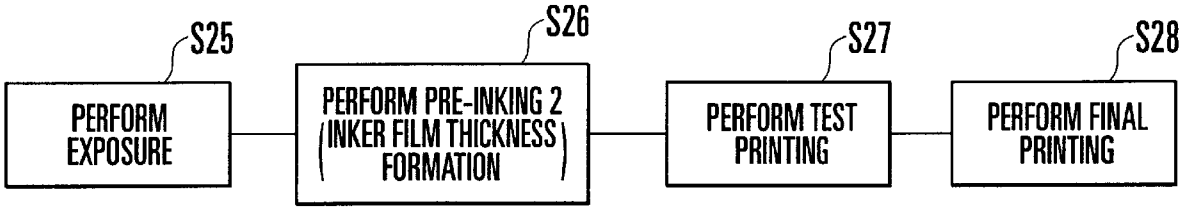
FIG. 12B PRIOR ART

FIGS. 1A and 1B show steps in continuously executing on-machine plate making and ink film thickness distribution formation by pre-inking 2 (in combination) with and without a preparatory process. FIG. 1A corresponds the steps in FIG. 12A. FIG. 1B corresponds to the steps in FIG. 12B. The arrangement of a printing press will be described with reference to FIG. 8 to 10.

[Preparatory Process]

Referring to FIG. 1A, the step of presetting the opening amount of an ink fountain key 9 to a value corresponding to an image to be exposed on a raw plate 5 (setting designated ink fountain key opening amount; step S26), which is one of the steps in forming an ink film thickness distribution by pre-inking 2, is executed concurrently with a preparatory process. The preparatory process is constituted by cleaning of the impression cylinder and blanket (step S22), paper size/paper thickness presetting (step S23), and automatic plate change (step S24). An operation time (designated ink fountain key opening amount setting time) tp4 taken to preset the opening amount of the ink fountain key 9 to a designated opening amount is excluded from a time (pre-inking time) tp taken to form an ink film thickness distribution by pre-inking 2, as indicated by equation (1) described later.

[Exposure and Pre-inking 2]

There is a difference between an exposure time tr and the time tp taken to form an ink film thickness distribution by pre-inking 2. In general, the time tp taken to form an ink film thickness distribution by pre-inking 2 is shorter than the exposure time tr. If, therefore, exposure and ink film thickness distribution formation by pre-inking 2 are simultaneously started, the exposure is not completed even after the completion of ink film thickness distribution formation by pre-inking 2. In this case, since the printing press keeps rotating until the exposure is completed, the ink film thickness distribution changes. As a consequence, a desired ink film thickness distribution may not be obtained when the exposure is completed, and test printing may be prolonged.

In this embodiment, the start timing of ink film thickness distribution formation by pre-inking 2 is delayed to simultaneously terminate the exposure and ink film thickness distribution formation by pre-inking 2. The time tp taken to form an ink film thickness distribution by pre-inking 2 varies depending on the image area ratio of an image to be exposed on the raw plate 5. The exposure time tr is determined by the size of the raw plate 5 and a designated rotational speed in exposure.

First of all, therefore, the exposure time tr and the time tp taken to form an ink film thickness distribution by pre-inking 2 are calculated. Then, the time tp taken to form an ink film thickness distribution by pre-inking 2 is subtracted from the exposure time tr to calculate a wait time tw (=tr−tp) between the instant at which exposure is started and the instant at which ink film thickness distribution formation by pre-inking 2 is started. This wait time tw will be termed as a pre-inking wait time.

The time tp taken to form an ink film thickness distribution by pre-inking 2 is obtained from a time (fountain roller portion designated ink film thickness distribution formation time) tp5 taken for ink film thickness formation on an ink fountain roller 8 and a time (inker portion designated ink film thickness distribution formation time) tp6 taken for ink film thickness distribution formation on an ink roller group 11 according to equation (11):

$$tp=tp5+tp6 \quad (1)$$

Note that the fountain roller portion designated ink film thickness distribution formation time tp5 is the value obtained by adding the time spent to preset the rotation amount of the ink fountain roller 8 to a value (designated rotation amount) corresponding to the image to be exposed on the raw plate 5 to the time spend to form an ink film having the thickness specified by the designated opening amount of the ink fountain key 9 preset in step S26-1 up to a portion on the ink fountain roller 8 which is in contact with an ink ductor roller 10. The inker portion designated ink film thickness distribution formation time tp6 is the time spent to superimpose an ink film thickness distribution (designated ink film thickness distribution) Mb corresponding to the image to be exposed on the raw plate 5 on a basic ink film thickness distribution Ma left on the ink roller group 11 by performing ink feed operation of the ink ductor roller 10 a predetermined number of times.

[Without Preparatory Process (With a Raw Plate Set and Ink Removing Done)]

Referring to FIG. 1B, exposure (step S25) in on-machine plate making is performed concurrently with ink film thickness distribution formation by pre-inking 2 (step S26), and the start timing of ink film thickness distribution formation by pre-inking 2 is delayed to simultaneously complete the two operations. In this case, the opening amount of the ink fountain key 9 is preset to a value corresponding to the image to be exposed on the raw plate 5 in step S26, and the fountain key designated opening amount setting time tp4 is included in the time tp taken to form an ink film thickness distribution by pre-inking 2.

When no preparatory process is performed, the time tp taken to form an ink film thickness distribution by pre-inking 2 is obtained from the fountain key designated opening amount setting time tp4, fountain roller portion designated ink film thickness distribution formation time tp5, and inker portion designated ink film thickness distribution formation time tp6 according to equation (2):

$$tp=tp4+tp5+tp6 \quad (2)$$

Subsequently, the pre-inking wait time tw (=tr−tp) between the instant at which exposure is started and the instant at which ink film thickness distribution formation by pre-inking 2 is started is calculated by subtracting the time tp taken to form an ink film thickness distribution by pre-inking 2 from the exposure time tr.

[Concurrent Execution of On-machine Plate Making and Pre-inking 1]

Figure 2A:
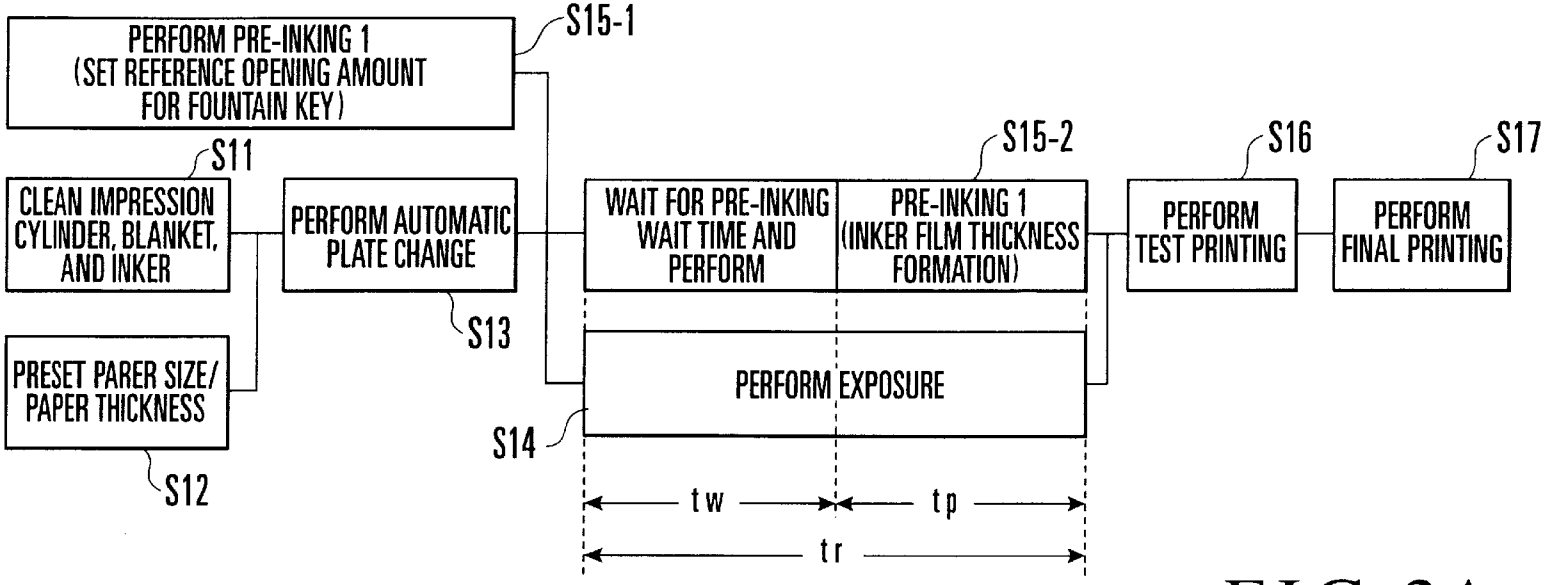
FIGS. 2A and 2B are views showing continuous processing for on-machine plate making and ink film thickness distribution formation by pre-inking 1 with and without a preparatory process.
Figure 2B:
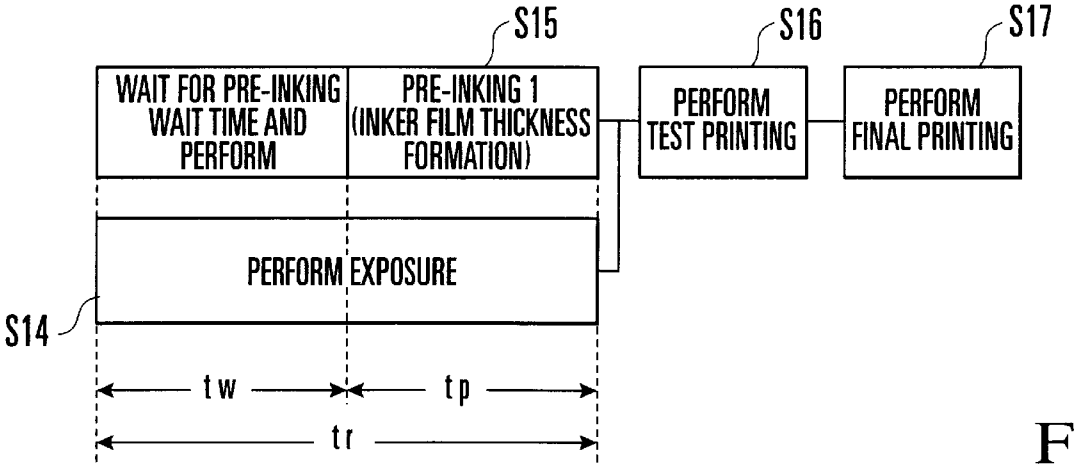
Figure 13A:
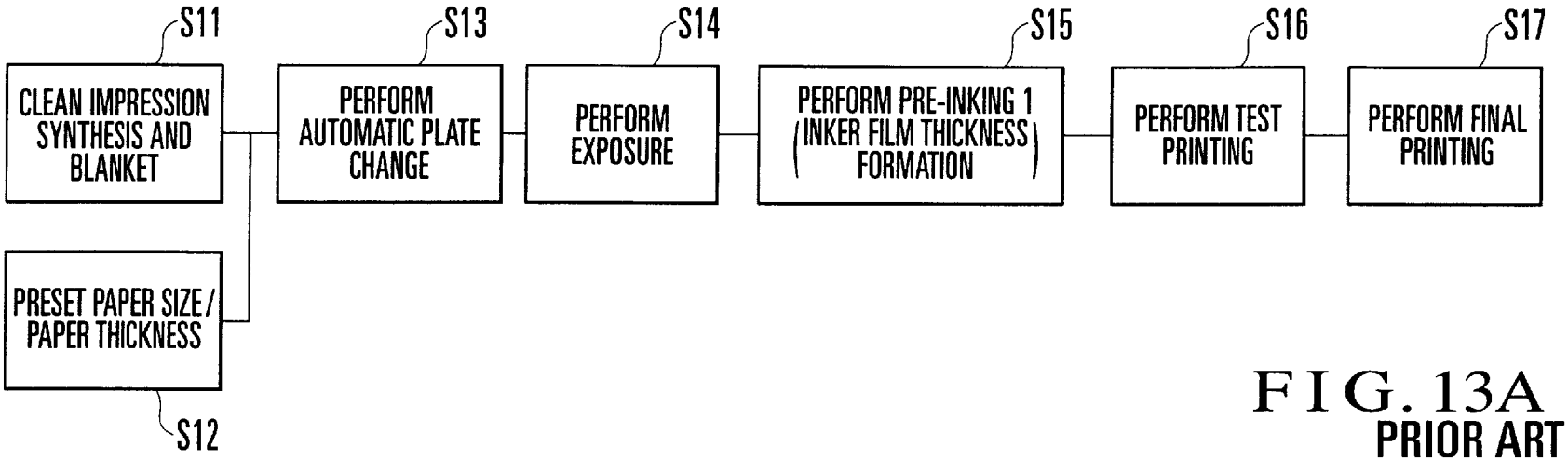
FIG. 13A PRIOR ART
FIG. 13A and 13B are views showing the conventional steps in serial processing for on-machine plate making and ink film thickness distribution formation by pre-inking 1 with and without a preparatory process.
Figure 13B:
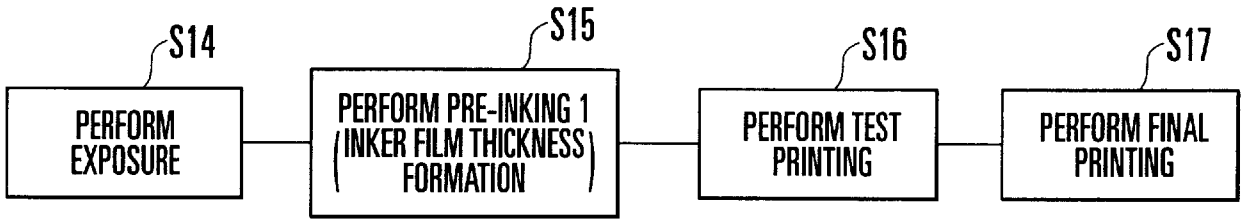
FIG. 13B PRIOR ART

FIGS. 2A and 2B show the steps in continuously executing on-machine plate making and ink film thickness distribution formation by pre-inking 1 (in combination) with and without a preparatory process. FIG. 2A, which shows the case with the preparatory process, corresponds the steps in FIG. 13A. FIG. 2B, which shows the case without any preparatory process, corresponds to the steps in FIG. 13B. In this embodiment, exposure in on-machine plate making and ink film thickness distribution formation by pre-inking 1 are concurrently executed, and the start timing of ink film thickness distribution formation by pre-inking 1 is delayed to simultaneously complete the two operations.

[Preparatory Process]

Referring to FIG. 2A, presetting of the opening amount of the ink fountain key 9 to a reference opening amount (step S15-1), which is included in ink film thickness distribution formation by pre-inking 1, is performed concurrently with the preparatory process. The preparatory process includes cleaning of the impression cylinder, blanket, and inker (step S11), paper size/paper thickness presetting (step S12), and automatic plate change (step S13). An operation time (entire fountain key reference opening amount setting time) tp1 spent to preset the opening amount of the ink fountain key 9 to the reference opening amount is excluded from the time (pre-inking time) tp taken to form an ink film thickness distribution by pre-inking 1, as indicated by equation (3) to be described later.

[Exposure and Pre-inking 1]

There is a difference between the exposure time tr and the time tp taken to form an ink film thickness distribution by pre-inking 2. In general, the time tp taken to form an ink film thickness distribution by pre-inking 2 is shorter than the exposure time tr. If, therefore, exposure and ink film thickness distribution formation by pre-inking 2 are simultaneously started, the exposure is not completed even after the completion of ink film thickness distribution formation by pre-inking 2. In this case, since the printing press keeps rotating until the exposure is completed, the ink film thickness distribution changes. As a consequence, a desired ink film thickness distribution may not be obtained when the exposure is completed, and test printing may be prolonged.

In this embodiment, the start timing of ink film thickness distribution formation by pre-inking 2 is delayed to simultaneously terminate the exposure and ink film thickness distribution formation by pre-inking 2. The time tp taken to form an ink film thickness distribution by pre-inking 2 varies depending on the image area ratio of an image to be exposed on the raw plate 5. The exposure time tr is determined by the size of the raw plate 5 and a designated rotational speed in exposure.

First of all, therefore, the exposure time tr and the time tp taken to form an ink film thickness distribution by pre-inking 2 are calculated. Then, the time tp taken to form an ink film thickness distribution by pre-inking 2 is subtracted from the exposure time tr to calculate the pre-inking wait time tw (=tr−tp) between the instant at which exposure is started and the instant at which ink film thickness distribution formation by pre-inking 2 is started.

The time tp taken to form an ink film thickness distribution by pre-inking 1 is obtained from a time (fountain roller portion basic ink film thickness distribution formation time) tp2 taken for basic ink film thickness distribution formation on the ink fountain roller 8, a time (inker portion basic ink film thickness distribution formation time) tp3 taken for basic film thickness distribution formation on an ink roller group 11, the fountain key designated opening amount setting time tp4, the fountain roller portion designated ink film thickness distribution formation time tp5, and inker portion designated ink film thickness distribution formation time tp6 according to equation (3):

$$tp=tp2+tp3+tp4+tp5+tp6 \quad (3)$$

Note that the fountain roller portion basic ink film thickness distribution formation time tp2 is the value obtained by adding the time spent to preset the rotation amount of the ink fountain roller 8 to a reference rotation amount to the time spent to form an ink film having the thickness specified by the reference opening amount of the ink fountain key 9 preset in step S15-1 up to a portion on the ink fountain roller 8 which is in contact with the ink ductor roller 10. The inker portion basic ink film thickness distribution formation time tp3 is the time spent to form the basic ink film thickness distribution Ma on the ink roller group 11 by performing ink feed operation of the ink ductor roller 10 a predetermined number of times.

[Without Preparatory Process (With Raw Plate Set)]

Referring to FIG. 2B, exposure in on-machine plate making (step S14) and ink film thickness distribution formation by pre-inking 1 (step S15) are concurrently executed, and the start timing of ink film thickness distribution formation by pre-inking 1 is delayed to simultaneously complete the two operations. In this case, the opening amount of the ink fountain key 9 is preset to a reference opening amount in step S15, and entire fountain key reference opening amount setting time tp1 is included in the time tp taken to form an ink film thickness distribution by pre-inking 1.

When no preparatory process is performed, the time tp taken to form an ink film thickness distribution by pre-inking 1 is obtained from the entire fountain key reference opening amount setting time tp1, fountain roller portion basic ink film thickness distribution formation time tp2, inker portion basic ink film thickness distribution formation time tp3, fountain key designated opening amount setting time tp4, fountain roller portion designated ink film thickness distribution formation time tp5, and inker portion designated ink film thickness distribution formation time tp6 according to equation (4):

$$tp=tp1+tp2+tp3+tp4+tp5+tp6 \quad (4)$$

Subsequently, the pre-inking wait time tw (=tr−tp) between the instant at which exposure is started and the instant at which ink film thickness distribution formation by pre-inking 1 is started is calculated by subtracting the time tp taken to form an ink film thickness distribution by pre-inking 1 from the exposure time tr.

Figure 3:
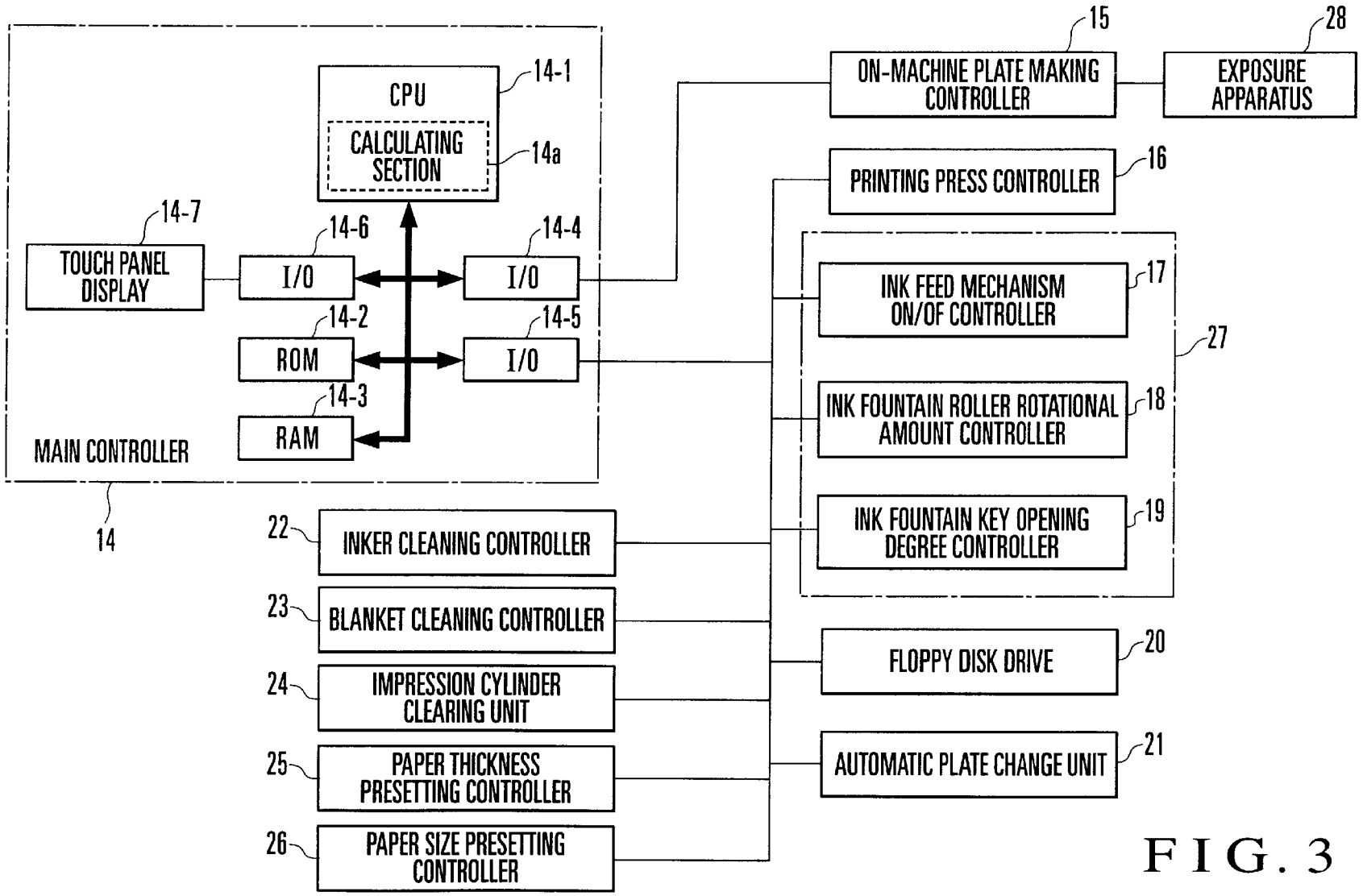
FIG. 3 is a block diagram showing a printing press according to an embodiment of the present invention.

FIG. 3 shows a printing press for performing the above continuous processing according to an embodiment of the present invention. Referring to FIG. 3, reference numeral 14 denotes a main controller; 15, an on-machine plate making controller for performing plate making with respect to the raw plate 5 mounted on a plate cylinder 3 by controlling an exposure apparatus 28; 16, a printing press controller for controlling the printing operation of the printing press; 17, an ink feed mechanism ON/OFF controller (to be referred to as an ink feed controller hereinafter) for ON/OFF-controlling the ink feed operation of the ink ductor roller; 18, an ink fountain roller rotational amount controller for controlling the rotation amount of the ink fountain roller 8; 19, an ink fountain key opening degree controller for controlling the opening degree of the ink fountain key 9; 20, a floppy disk drive (to be referred to as a drive unit hereinafter) for reading out the image area ratio of the image to be exposed on the raw plate 5 from a floppy disk; 21, an automatic plate change unit for automatically change an old plate with the new plate 12, 22, an inker cleaning controller for cleaning the interior of the inker; 23, a blanket cleaning controller for cleaning the blanket; 24, an impression cylinder clearing unit for cleaning the impression cylinder; 25, a paper thickness presetting controller for presetting a paper thickness; and 26, a paper size presetting controller for presetting a paper size.

The main controller 14 includes a CPU (Central Processing Unit) 14-1, ROM (Read Only Memory) 14-2, RAM (Random Access Memory) 14-3, interfaces (I/Os) 14-4 to 14-6, and touch panel display 14-7. The CPU 14-1 includes a calculating section 14*a* for calculating the time tp according to equations (1) to (4), and also calculating the respective times tp1 to tp6, tw, and tr.

The CPU 14-1 obtains various kinds of input information supplied via the interfaces 14-4 to 14-6 and performs various operations upon accessing the RAM 14-3 in accordance with the programs stored in the ROM 14-2. Various kinds of processing information in the CPU 14-1 are output to the display 14-7, on-machine plate making controller 15, printing press controller 16, ink feed controller 17, ink fountain roller rotational amount controller 18, ink fountain key opening degree controller 19, drive unit 20, automatic plate change unit 21, inker cleaning controller 22, blanket cleaning controller 23, impression cylinder clearing unit 24, paper thickness presetting controller 25, and paper size presetting controller 26 via the interfaces 14-4 to 14-6. The ink feed controller 17, ink fountain roller rotational amount controller 18, and ink fountain key opening degree controller 19 constitute a pre-inking controller 27.

[Concurrent Execution of On-machine Plate Making and Pre-inking 2]

Figure 4:
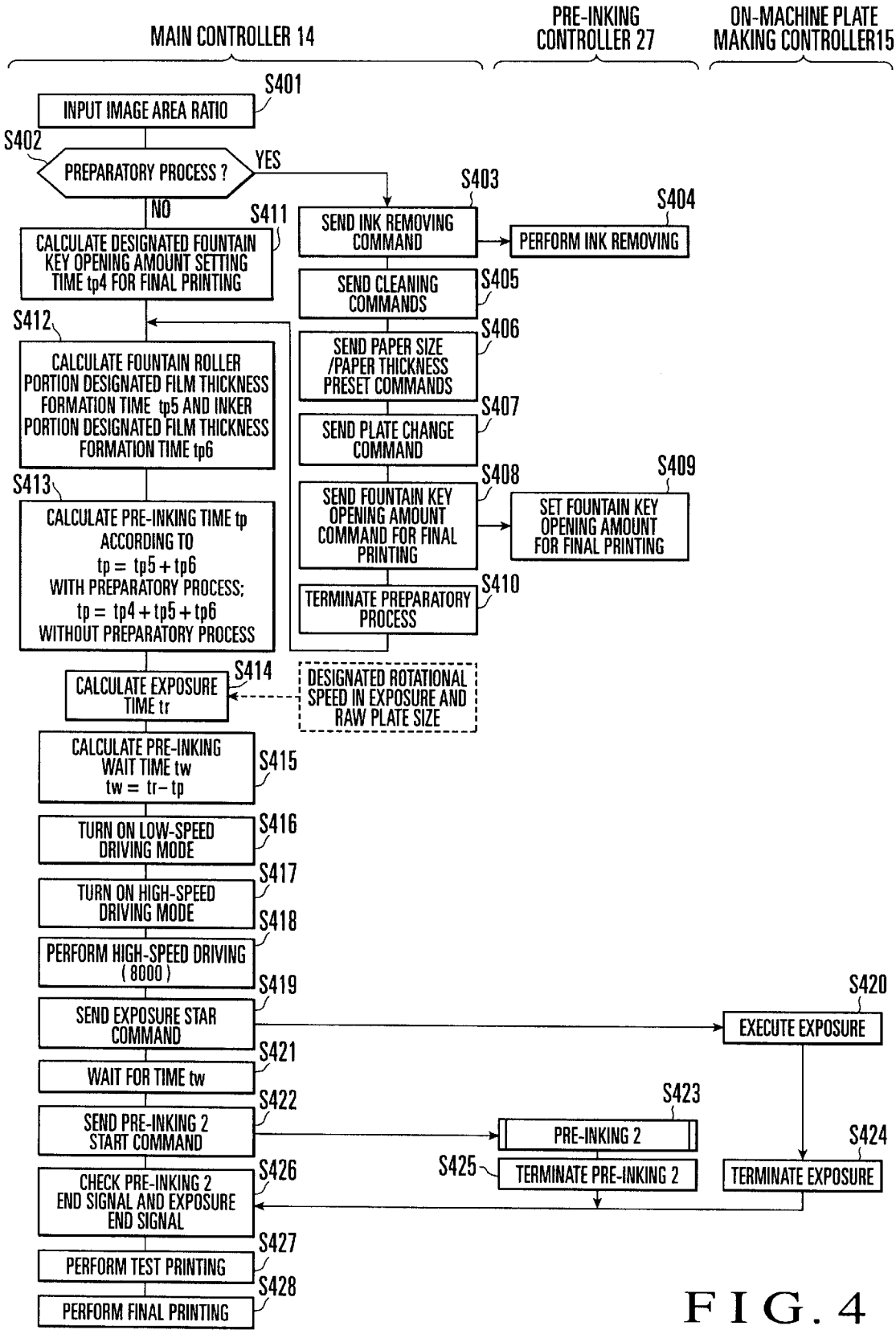
FIG. 4 is a flow chart showing continuous processing for on-machine plate making and ink film thickness distribution formation by pre-inking 2 performed by the printing press in FIG. 3.

FIG. 4 shows continuous processing for on-machine plate making and ink film thickness distribution formation by pre-inking 2, which is performed by the main controller 14, on-machine plate making controller 15, and pre-inking controller 27. Referring to FIG. 4, the CPU 14-1 of the main controller 14 reads out the image area ratio of the image to be exposed on the raw plate 5 from the floppy disk set in the drive unit 20 (step S401).

Subsequently, the CPU 14-1 checks the necessity of a preparatory process. More specifically, the CPU 14-1 determines whether to start with a preparatory process including ink removing, cleaning of the impression cylinder and blanket, paper size/paper thickness presetting, and plate change or on-machine plate making because the preparatory process has been completed.

When the CPU 14-1 starts with the preparatory process, it sends an ink removing command to the pre-inking controller 27 in accordance with the process shown in FIG. 1A (step S403) to perform ink removing while the old printing plate is mounted on the plate cylinder 3 (step S404). With this operation, the basic ink film thickness distribution Ma that decreases in thickness from upstream to downstream is left on the ink roller group 11. The operation in step S404 corresponds to that in step S21 in FIG. 1A.

After the ink removing, the CPU 14-1 sends cleaning commands to the blanket cleaning controller 23 and impression cylinder clearing unit 24 (step S405) to clean the impression cylinder and blanket. The CPU 14-1 sends paper size/paper thickness preset commands to the paper thickness presetting controller 25 and paper size time tp6. The CPU 14-1 then calculates the time tp taken to form an ink film thickness distribution by pre-inking 2 from the fountain key designated opening amount setting time tp4, fountain roller portion designated ink film thickness distribution formation time tp5, and inker portion designated ink film thickness distribution formation time tp6 (step S413). In this case, if it is determined in step S402 that a preparatory process is to be performed, the CPU 14-1 calculates tp (=tp5+tp6) according to equation (1). If it is determined in step S402 that no preparatory process is to be performed, the CPU 14-1 calculates tp (=tp4+tp5+tp6) according to equation (2).

The CPU 14-1 then calculates the exposure time tr from the designated rotational speed in exposure and the size of the raw plate 5 (step S414). The CPU 14-1 calculates the pre-inking wait time tw (tw=tr−tp) between the instant at which exposure is started and the instant at which ink film thickness distribution formation by pre-inking 2 is started by subtracting the time tp taken to form an ink film thickness distribution by pre-inking 2 from the calculated exposure time tr (step S415).

Upon calculating the pre-inking wait time tw, the CPU 14-1 sends a command to the printing press controller 16 to raise the rotational speed of the printing press to the designated rotational speed in presetting controller 26 (step S406) to preset a paper size/paper thickness. The CPU 14-1 sends a printing plate change command (step S407) to the automatic plate change unit 21 to change the old printing plate to the raw plate 5. The CPU 14-1 then sends a fountain key opening amount set command to the pre-inking controller 27 (step S408) to preset the opening amount of each ink fountain key 9 to a value corresponding to the image to be exposed on the raw plate 5 (step S409).

The operation based on the commands in steps S405 to S407 corresponds to that in steps S22 to S24 in FIG. 1A. The operation in step S409 corresponds to that in step S26-1 in FIG. 1A. After the preparatory process is completed (step S410), the flow advances to step S412.

Assume that the preparatory process has already been completed, and the CPU 14-1 is to start with on-machine plate making, i.e., the raw plate 5 having undergone ink removing has already been mounted. In this case, in accordance with the process in FIG. 1B, the calculating section 14*a* (to be omitted hereinafter) of the CPU 14-1 calculates the fountain key designated opening amount setting time tp4 (step S411). The flow then advances to step S412.

In step S412, the CPU 14-1 calculates the fountain roller portion designated ink film thickness distribution formation time tp5 and inker portion designated ink film thickness distribution formation exposure (steps S416, S417, and S418). The CPU 14-1 sends an exposure start command to the on-machine plate making controller 15 (step S419). As a consequence, the plate making apparatus 2 starts to expose the image on the raw plate 5 (step S420). The operation in step S420 corresponds to that in step S25 in FIGS. 1A and 1B.

The CPU 14-1 waits for the calculated pre-inking wait time tw (step S421), and sends a pre-inking 2 start command to the pre-inking controller 27 (step S422). Upon reception of the pre-inking 2 start command, the pre-inking controller 27 performs ink film thickness distribution formation by "pre-inking 2" (step S423).

Figure 5:
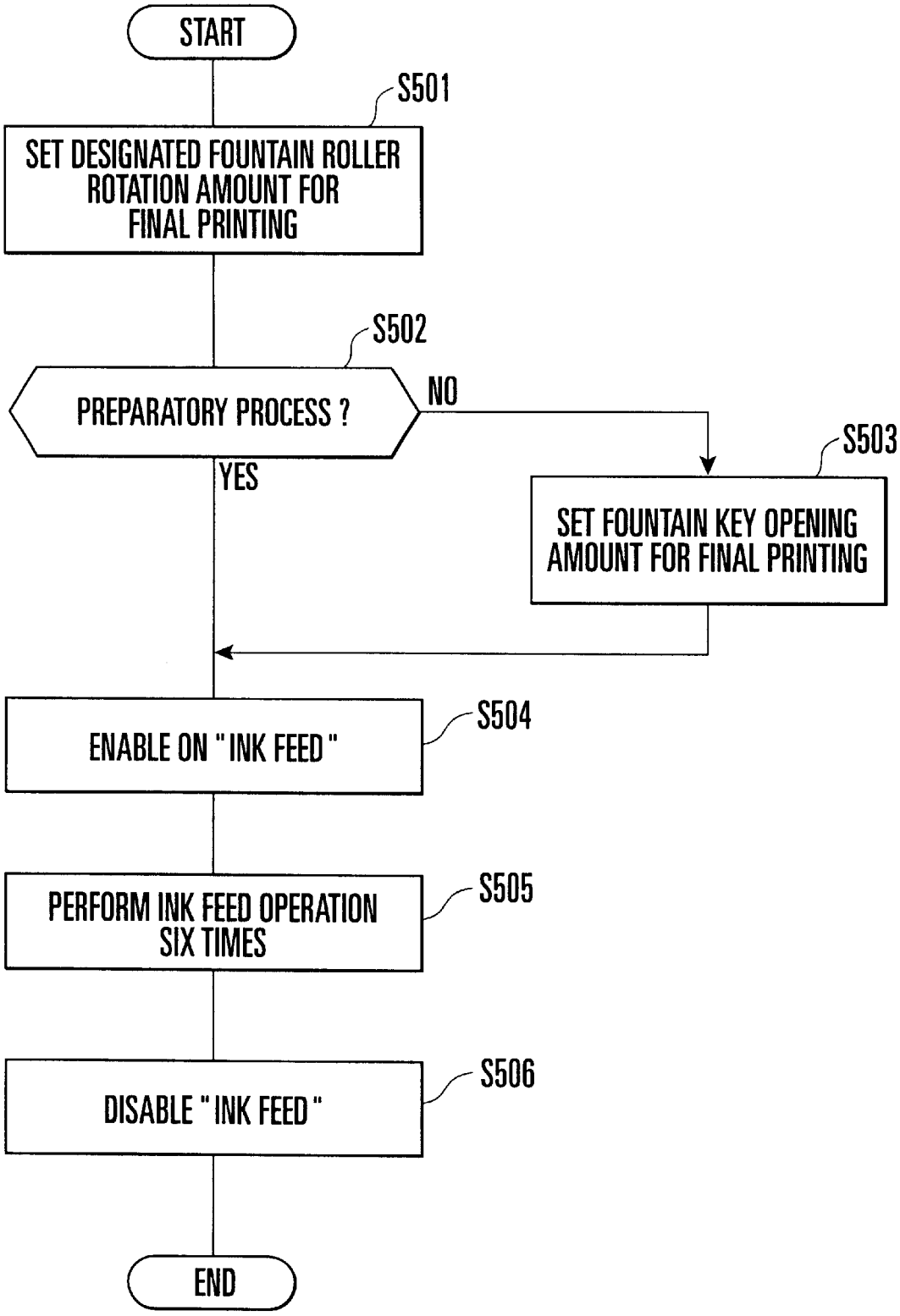
FIG. 5 is a flow chart showing the details of the processing of pre-inking 2 in FIG. 4.

FIG. 5 shows the processing in step S423 in detail. Upon reception of the pre-inking 2 start command from the CPU 14-1, the pre-inking controller 27 presents the rotational amount of the ink fountain roller 8 to a value corresponding to the image to be exposed on the raw plate 5 (step S501). Thereafter, the CPU 14-1 checks the necessity of a preparatory process (step S502).

When the CPU 14-1 is to start with on-machine plate making, i.e., a preparatory process is to be performed, it sends an ink feed command to the pre-inking controller 27. When "ink feed" is enabled in response to this ink feed command (step S504), and the ink feed operation of the ink ductor roller 10 is performed six times (step S505), "ink feed" is disabled (step S506). With this operation, the image ink film thickness distribution Mb is superimposed on the basic ink film thickness distribution Ma left on the ink roller group 11. This operation in steps S501, S502, and S504 to S506 corresponds to that in the step S26-2 in FIG. 1A.

When the CPU 14-1 starts with on-machine plate making, i.e., no preparatory process is to be performed, it sends a fountain key opening amount set command to the pre-inking controller 27 to preset the opening amount of the ink fountain key 9 to a value corresponding to the image to be exposed (step S503). The CPU 14-1 sends an ink feed command to the pre-inking controller 27 to perform the ink feed operation of the ink ductor roller 10 six times (steps S504 to S506). With this operation, the image ink film thickness distribution Mb is superimposed on the basic ink film thickness distribution Ma left on the ink roller group 11. The operation in steps S501 to S506 corresponds to that in step S26 in FIG. 1B.

When the exposure is completed, the on-machine plate making controller 15 sends an exposure end signal to the CPU 14-1 (step S424). Upon completion of ink film thickness distribution formation by pre-inking 2, the pre-inking controller 27 sends a pre-inking 2 end signal to the CPU 14-1 (step S425). The CPU 14-1 checks the reception of the exposure end signal from the on-machine plate making controller 15 and the pre-inking 2 end signal from the pre-inking controller 27 (step S426) and starts test printing (step S427). If a satisfactory tone is obtained in this test printing, the flow advances to final printing (step S428).

[Concurrent Execution of On-machine Plate Making and Pre-inking 1]

Figure 6:
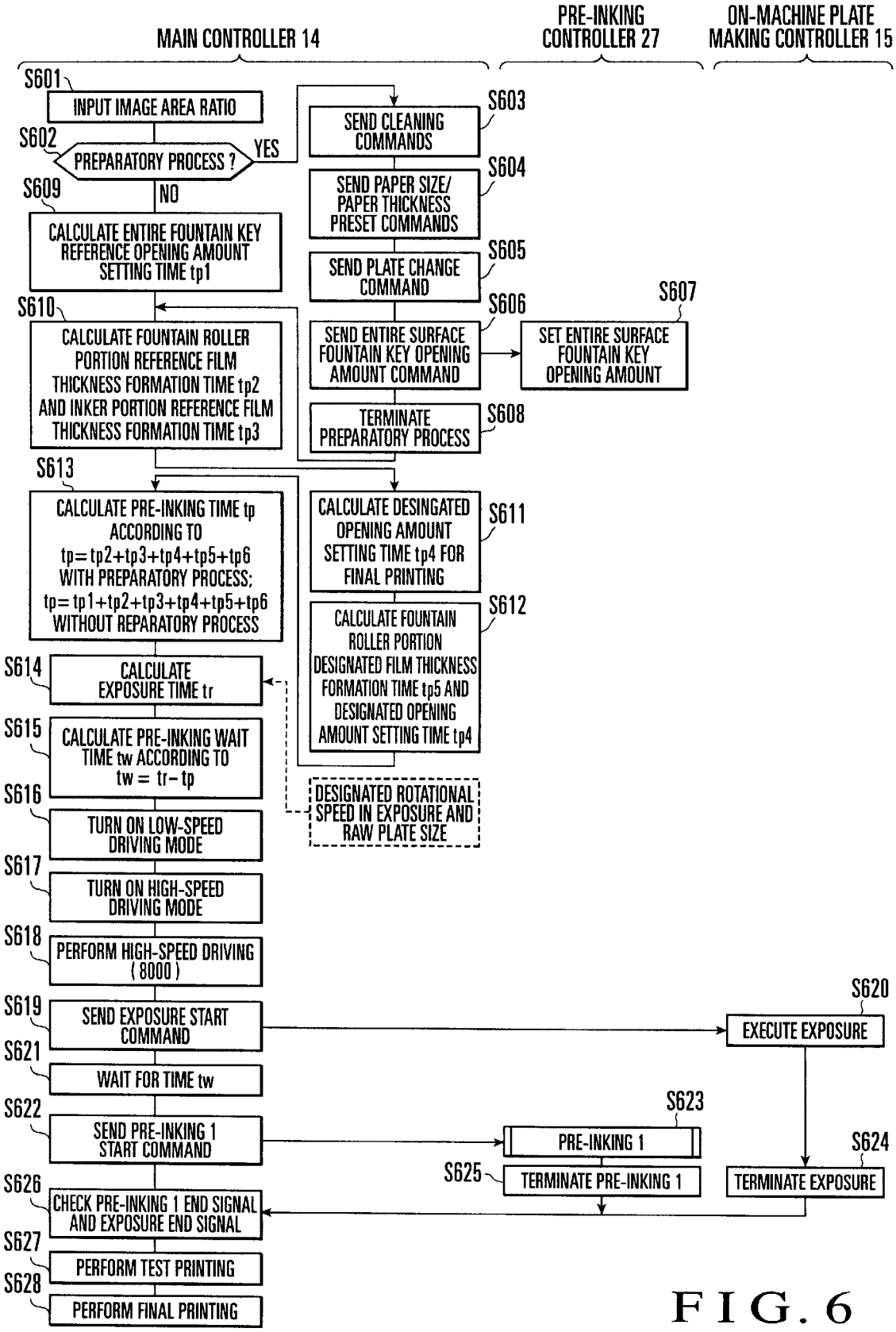
FIG. 6 is a flow chart showing continuous processing for on-machine plate making and ink film thickness distribution formation by pre-inking 1 performed by the printing press in FIG. 3.

FIG. 6 shows continuous processing for on-machine plate making and ink film thickness distribution formation by pre-inking 1, which is performed by the main controller 14, on-machine plate making controller 15, and pre-inking controller 27. Referring to FIG. 6, the CPU 14-1 of the main controller 14 reads out the image area ratio of the image to be exposed on the raw plate 5 from the floppy disk set in the drive unit 20 (step S601).

The CPU 14-1 checks the necessity of a preparatory process (step S602). If the CPU 14-1 starts with a preparatory process, it sends cleaning commands to the inker cleaning controller 22, blanket cleaning controller 23, and impression cylinder clearing unit 24 in accordance with the process shown in FIG. 2A (step S603) to clean the impression cylinder, blanket, and inker. The CPU 14-1 also sends paper size/paper thickness preset commands to the paper thickness presetting controller 25 and paper size presetting controller 26 (step S604) to preset a paper size/paper thickness. The CPU 14-1 sends a plating change command to the automatic plate change unit 21 (step S605) to change the old printing plate 12 to the raw plate 5. In addition, the CPU 14-1 sends an entire surface fountain key opening amount set command to the pre-inking controller 27 (step S606) to preset the opening amount of the ink fountain key 9 to a reference opening amount (step S607).

The operation based on the commands in steps S603 to 605 corresponds to that in steps S11 to S13 in FIG. 2A. The operation in step S606 corresponds to that in step S15-1 in FIG. 2A. After this preparatory process (step S608), the flow advances to step S610.

If the raw plate 5 has already been mounted and the CPU 14-1 is to start with on-machine plate making, it calculates the entire fountain key reference opening amount setting time tp1 (step S609), and the flow advances to step S610.

In step S610, the CPU 14-1 calculates the fountain roller portion basic ink film thickness distribution formation time tp2 and inker portion basic ink film thickness distribution formation time tp3. The CPU 14-1 then calculates the fountain key designated opening amount setting time tp4 (step S611) and also calculates the fountain roller portion designated ink film thickness distribution formation time tp5 and inker portion designated ink film thickness distribution formation time tp6 (step S612). The CPU 14-1 then calculates the time tp taken to form an ink film thickness distribution by pre-inking 1 from the entire fountain key reference opening amount setting time tp1, fountain roller portion basic ink film thickness distribution formation time tp2, inker portion basic ink film thickness distribution formation time tp3, fountain key designated opening amount setting time tp4, fountain roller portion designated ink film thickness distribution formation time tp5, and inker portion designated ink film thickness distribution formation time tp6 (step S613).

In this case, if it is determined that a preparatory process is to be performed, the CPU 14-1 calculates the pre-inking time tp according to tp=tp2+tp3+tp4+tp5+tp6. If it is determined in step S602 that no preparatory process is to be performed, the CPU 14-1 calculates the pre-inking time tp according to tp=tp1+tp2+tp3+tp4+tp5+tp6.

The CPU 14-1 calculates the exposure time tr on the basis of a designated rotational speed in exposure and the size of the raw plate 5 (step S614). The CPU 14-1 calculates the pre-inking wait time tw (=tr−tp) between the instant at which exposure is started and the instant at which ink film thickness distribution formation by pre-inking 1 is started by subtracting the time tp taken to form an ink film thickness distribution by pre-inking 1 from the exposure time tr (step S615).

The CPU 14-1 sends a command to the printing press controller 16 to raise the rotational speed of the printing press to the designated rotational speed in exposure (steps S616 to S618). The CPU 14-1 sends an exposure start command to the on-machine plate making controller 15 (step S619). Upon reception of the exposure start command, the on-machine plate making controller 15 operates the plate making apparatus 2 to start exposing the image on the raw plate 5 (step S620). The operation in step S620 corresponds to that in step S14 in FIGS. 2A and 2B.

The CPU 14-1 waits for the calculated pre-inking wait time tw (step S621) and sends a pre-inking 1 start command to the pre-inking controller 27 (step S622). Upon reception of this pre-inking 1 start command, the pre-inking controller 27 performs ink film thickness distribution formation by "pre-inking 1" (step S623).

Figure 7:
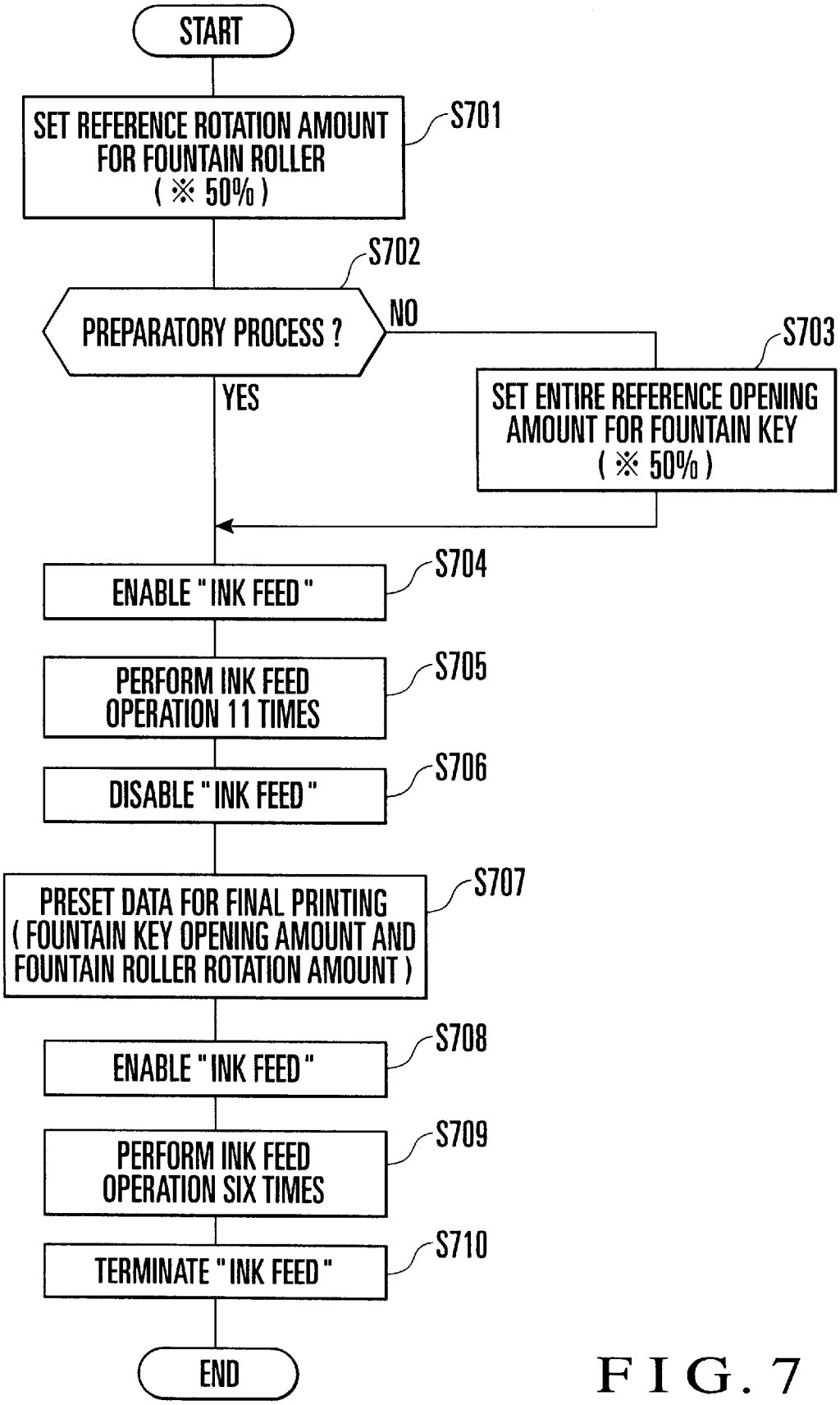
FIG. 7 is a flow chart showing the details of the processing of pre-inking 1 in FIG. 6.

FIG. 7 shows the processing in step S623 in detail. Upon reception of the pre-inking 1 start command from the CPU 14-1, the pre-inking controller 27 presets the rotation amount of the ink fountain roller 8 to a reference rotation amount (step S701). Thereafter, the CPU 14-1 checks the necessity of a preparatory process (step S702).

When the CPU 14-1 starts with the preparatory process, it sends an ink feed command to the pre-inking controller 27 to enable "ink feed" (step S704). After the ink feed operation of the ink ductor roller 10 is performed 11 times by enabling "ink feed" (step S705), "ink feed" is disabled (step S706). With this operation, the basic ink film thickness distribution Ma is formed on the ink roller group 11.

Subsequently, the CPU 14-1 sends a data preset command to the pre-inking controller 27 (step S707). In accordance with this command, the opening amount of each of the ink fountain keys 9-1 to 9-n is preset to a value corresponding to the image to be exposed on the raw plate 5, and the rotation amount of the ink fountain roller 8 is preset to a value corresponding to the image to be exposed on the raw plate 5. The CPU 14-1 then sends an ink feed command to the pre-inking controller 27 to perform the ink feed operation of the ink ductor roller 10, for example, six times (steps S708 to S710). With this operation, the image ink film thickness distribution Mb is superimposed on the basic ink film thickness distribution Ma formed on the ink roller group 11. The operation in steps S701, S702, and S704 to S710 corresponds to that in step S15-2 in FIG. 2A.

When the preparatory process has already been completed and the CPU 14-1 starts with on-machine plate making, i.e., no preparatory process is to be performed, it sends an entire reference opening amount set command to the pre-inking controller 27 to preset the opening amount of each of the ink fountain keys 9-1 to 9-n to a reference opening amount (step S703). The CPU 14-1 then sends an ink feed command to the pre-inking controller 27 to perform the ink feed operation of the ink ductor roller 10, for example, 11 times (steps S704 to S706). With this operation, the basic ink film thickness distribution Ma is formed on the ink roller group 11.

Subsequently, the CPU 14-1 sends a data preset command for final printing to the pre-inking controller 27 (step S707). In accordance with this command, the opening amount of the ink fountain key 9 is preset to a value corresponding to the image to be exposed on the raw plate 5, and the rotation amount of the ink fountain roller 8 is preset to a value corresponding to the image to be exposed on the raw plate 5. The CPU 14-1 sends an ink feed command to the pre-inking controller 27 to perform the ink feed operation of the ink ductor roller 10, for example, six times (steps S708 to S710). With this operation, the image ink film thickness distribution Mb is superimposed on the basic ink film thickness distribution Ma formed on the ink roller group 11. The operation in steps S701 to S710 corresponds to that in step S15 in FIG. 2B.

When the exposure is completed, the on-machine plate making controller 15 sends an exposure end signal to the CPU 14-1 (step S624). When ink film thickness distribution formation by pre-inking 1 is completed, the pre-inking controller 27 sends a pre-inking 1 end signal to the CPU 14-1 (step S625). The CPU 14-1 checks the reception of the exposure end signal from the on-machine plate making controller 15 and the pre-inking 1 end signal from the pre-inking controller 27 (step S626) and starts test printing (step S627). If a satisfactory tone is obtained in this test printing, the flow advances to final printing (step S628).

In the above embodiment, exposure and ink film thickness distribution formation by pre-inking 1/pre-inking 2 are simultaneously terminated. However, they need not always be terminated simultaneously. That is, after exposure, ink film thickness distribution formation by pre-inking 1/pre-inking 2 may be terminated with a slight delay. Alternatively, after ink film thickness distribution formation by pre-inking 1/pre-inking 2, exposure may be terminated with a slight delay.

In addition, in the above embodiment, as shown in FIGS. 1A and 2A, the opening amount of the ink fountain key 9 is preset to a value corresponding to the image to be exposed on the raw plate 5 during a preparatory process. However, this presetting operation may be performed concurrently with the exposure after the preparatory process. In this case, as in the cases shown in FIG. 1B and 2B, the fountain key designated opening amount setting times tp4 and tp1 spent to preset the opening amount of the ink fountain key 9 to a value corresponding to the image to be exposed on the raw plate 5 may be included in the pre-inking time tp.

In the above embodiment, an automatic plate change unit is disclosed in Japanese Patent Laid-Open No. 02-258993; an inker cleaning unit, in Japanese Patent Laid-Open Nos. 10-193578 and 10-286944; a blanket cleaning unit, in Japanese Patent Laid-Open Nos. 05-200995 and 09-39215; an impression cylinder cleaning unit, in Japanese Patent Laid-Open Nos. 02-286245 and 03-114748; a paper size presetting unit, in Japanese Patent Laid-Open No. 63-127923; and a paper thickness presetting unit, in Japanese Patent Laid-Open No. 63-134244. The techniques disclosed in these references are incorporated in this specification.

Note that the number of times of ink feed operation of the ink ductor roller 10 can be set to an arbitrary value in step S505 in FIG. 5 and step S705 in FIG. 7.

As has been described above, according to the present invention, since exposing of an image on a printing plate and the operation of forming an ink film thickness distribution in the inking device are performed concurrently at least partly, the operation of forming an ink film thickness distribution in the inking device (the operation of forming an ink film thickness distribution on the ink roller group) is performed while exposing of the image on the printing plate (raw plate) is performed, thereby shortening the time spent until final printing is started.

In addition, by simultaneously terminating image exposing and ink film thickness distribution formation, a desired ink film thickness distribution can be obtained almost at the same time the image exposing is completed. This makes it possible to avoid, for example, the problem that test printing is prolonged due to changes in ink film thickness distribution.

What is claimed is:

1. A printing press comprising:

an ink roller group for supplying ink stored in an ink fountain to a printing plate mounted on a plate cylinder;

image exposing means for exposing an image on a printing plate before plate making which is mounted on the plate cylinder;

ink film thickness distribution formation means for forming an ink film thickness distribution corresponding to the image to be exposed on the printing plate on said ink roller group; and control means for performing image exposing and ink film thickness distribution formation concurrently at least partly by controlling said image exposing means and said ink film thickness distribution formation means.

2. A press according to claim 1, wherein said control means controls to terminate image exposing by said image exposing means and ink film thickness distribution formation by said ink film thickness distribution formation means substantially at the same time.

3. A press according to claim 2, wherein said control means comprises calculation means for calculating a wait time between the instant at which image exposing is started and the instant at which ink film thickness distribution formation is started on the basis of a time taken for image exposing by said image exposing means and a time taken for ink film thickness distribution formation by said ink film thickness distribution formation means, and the ink film thickness distribution formation is started after a lapse of the wait time calculated by said calculation means.

4. A press according to claim 3, wherein said press further comprises:

an ink fountain key for adjusting the amount of ink supplied from the ink fountain; and an ink fountain roller for supplying the ink supplied from the ink fountain via said ink fountain key to said ink roller group, and when said ink roller group holds no ink, said calculation means calculates an ink film thickness distribution formation time by adding at least a time taken for basic ink film thickness distribution formation on said ink fountain roller, a time taken for basic ink film thickness distribution formation on said ink roller group, a time taken to set a designated opening amount for said ink fountain key, a time taken for designated ink film thickness distribution formation on said ink fountain roller, and a time taken for designated ink film thickness distribution formation on said ink roller group.

5. A press according to claim 3, wherein said press further comprises an ink fountain roller for supplying the ink supplied from the ink fountain to said ink roller group, and when an old printing plate mounted on the plate cylinder is to be changed to a new printing plate, said calculation means obtains an ink film thickness distribution formation time by adding at least a time taken for designated ink film thickness distribution formation on said ink fountain roller and a time taken for designated ink film thickness distribution formation on said ink roller group.

6. A press according to claim 3, wherein when a preparatory process including at least one of ink removing, cleaning of an impression cylinder and a blanket, paper size/paper thickness presetting, and plate change is not performed before image exposing, said calculation means calculates an ink film thickness distribution formation time including a time taken to set a designated opening amount for said ink fountain key.

7. A control method for a printing press including an ink roller group for supplying ink stored in an ink fountain to a printing plate mounted on a plate cylinder, comprising the steps of:

exposing an image on a printing plate before plate making which is mounted on the plate cylinder;

forming an ink film thickness distribution corresponding to the image to be exposed on the printing plate on the ink roller group; and controlling to perform image exposing and ink film thickness distribution formation concurrently at least partly.

8. A method according to claim 7, wherein the control step comprises the step of terminating image exposing and ink film thickness distribution formation substantially at the same time.

9. A method according to claim 8, wherein the control step comprises the steps of:

calculating a wait time between the instant at which image exposing is started and the instant at which ink film thickness distribution formation is started on the basis of a time taken for image exposing and a time taken for ink film thickness distribution formation, and starting the ink film thickness distribution formation when the calculated wait time elapses after image exposing is started.

10. A method according to claim 9, wherein the step of calculating comprises, when the ink roller group holds no ink, the step of obtaining an ink film thickness distribution formation time by adding at least a time taken for basic ink film thickness distribution formation on the ink fountain roller for supplying the ink, supplied from the ink fountain for which an amount of ink to be supplied is adjusted by an ink fountain key, to the ink roller group, a time taken for basic ink film thickness distribution formation on the ink roller group, a time taken to set a designated opening amount for the ink fountain key, a time taken for designated ink film thickness distribution formation on the ink fountain roller, and a time taken for designated ink film thickness distribution formation on the ink roller group.

11. A method according to claim 9, wherein the step of calculating comprises the step of obtaining, when an old printing plate mounted on the plate cylinder is to be changed to a new printing plate, an ink film thickness distribution formation time by adding at least a time taken for designated ink film thickness distribution formation on an ink fountain roller for supplying the ink, supplied from the ink fountain for which an amount of ink to be supplied is adjusted by an ink fountain key, to the ink roller group and a time taken for designated ink film thickness distribution formation on the ink roller group.

12. A method according to claim 9, wherein the step of calculating comprises the step of, when a preparatory process including at least one of ink removing, cleaning of an impression cylinder and a blanket, paper size/paper thickness presetting, and plate change is not performed before image exposing, calculating an ink film thickness distribution formation time including a time taken to set a designated opening amount for the ink fountain key.

* * * * *